United States Patent [19]

Ohmori et al.

[11] 4,033,293

[45] July 5, 1977

[54] DEVELOPING DEVICE OF AN ELECTROPHOTOGRAPHIC COPYING MACHINE

[75] Inventors: Hitoshi Ohmori, Mino; Kiyoshi Horie, Atsugi, both of Japan

[73] Assignee: Rank Xerox Ltd., London, England

[22] Filed: Sept. 13, 1976

[21] Appl. No.: 722,946

[30] Foreign Application Priority Data

Nov. 20, 1975 Japan ..... 50-138757

[52] U.S. Cl. ..... 118/653; 118/656

[51] Int. Cl.[2] ..... B05B 5/02

[58] Field of Search ..... 118/653, 651, 655, 656; 355/3 R, 3 DD

[56] References Cited

UNITED STATES PATENTS

| | | | |
|---|---|---|---|
| 3,848,566 | 11/1974 | Stange | 118/656 |
| 3,900,002 | 8/1975 | Stange | 118/656 |

*Primary Examiner*—Ronald Feldbaum
*Attorney, Agent, or Firm*—Earl T. Reichert

[57] ABSTRACT

To prevent toner from being deposited on or adhering to certain parts within a developing apparatus, the parts are coated with a conductive layer having no affinity with the toner.

3 Claims, 5 Drawing Figures

DEVELOPING DEVICE OF AN ELECTROPHOTOGRAPHIC COPYING MACHINE

BACKGROUND OF THE INVENTION

This invention relates to a developing device for an electrophotographic copying machine, and more particularly to a developing device which is characterized by the feature that the surface of the parts located within the developing device which will come into contact with a developer material during machine operation is coated with a conductive material having no affinity with the developer material.

Generally, an electrophotographic copying machine includes a light-sensitive member having a photoconductive surface layer, on which an electrostatic charge pattern is formed by uniformly charging the surface followed by image exposure so as to discharge the charge in proportion to the intensity of the exposure light. The electrostatic charge pattern thus formed is then developed with a developer to obtain a visible powder image which is in turn transferred onto a support such as copying paper and fixed thereon to obtain a permanent image. In an electrophotographic copying machine of the type described herein, there is employed a developing material consisting of finely divided pigmented resinous particles (toner) and relatively coarse granules (carrier) which attract each other as a result of triboelectrification. Carrier is generally prepared by coating granules of core material such as sand, glass and steel with a suitable coating material which, when subjected to triboelectrification, gives to the carrier a certain charge of the polarity distant from that of the toner. When the toner and carrier are mixed and undergo frictional contact, charges of opposite polarities are induced on the toner and carrier, respectively, causing them to adhere to each other.

One method in which a mixture of toner and carrier is used as a developer is known as cascade development. This method includes cascading the above mentioned developer over the surface of a light-sensitive plate so as to allow the toner to adhere to the image areas of the latent image on the light-sensitive plate. Cascade development has been widely used in the art of electrophotography because it is highly effective and can be carried out at low cost. One disadvantage of cascade development, however, is that due to the charge and the finely divided particulate nature of the developer, the toner tends to adhere to various parts such as the developing electrode within the developing device and set or solidify thereon. The toner rigidly adhering to the developing electrode will form an insulating layer on the surface thereof thereby causing the degradation of the effectiveness of the developing electrode. In addition, the developer will be charged at an extremely high potential since the charge thereof does not leak through the developing device, thus resulting in the lowering of the density of developed image.

SUMMARY OF THE INVENTION

An object of the present invention is to provide a developing device for use in an electrophotographic copying machine wherein the surfaces of the machine parts located within the developing device are coated with a material having electrical conductivity, but presenting no affinity with the developer so as to prevent the adhesion of the developer to these surfaces. This prevents the degradation of the ability of the developing electrode and the decrease in image density due to developer deposit.

DETAILED DESCRIPTION OF THE INVENTION

Figure 1:
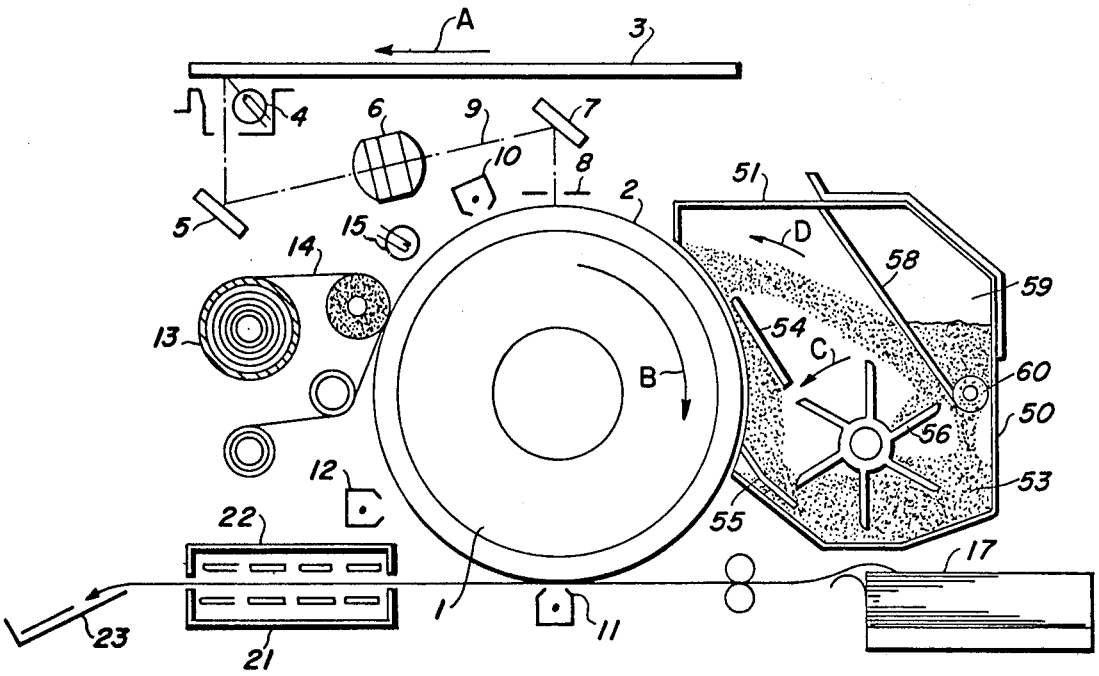
FIG. 1 is a schematic view of an electrophotographic copying machine.

The present invention will now be described in detail with reference to a preferred embodiment thereof illustrated in the attached drawings. FIG. 1 shows an electrophotographic copying machine employing a developing device according to thepresent invention, the machine having light sensitive plate in the form of a cylinder, the cylinder 1 having on its surface a layer of photoconductive insulating material 2 deposited by vacuum evaporation. The cylinder 1 is adapted to be rotated in the direction of an arrow B. An original document advancing platen 3 on which an original to be reproduced is placed is adapted to be propelled in the direction of an arrow A at a speed synchronized to that of the cylinder 1. Assuming that the original on the platen is illuminated by a light source 4, the light rays reflected by the original will be projected to the cylinder 1 through a reflecting mirror 5, a converging lens 6, a second reflecting mirror 7, and a slit 8. Since the surface of the photoconductive insulating material 2 has been previously electrically charged by a corona device 10, an electrostatic latent image is formed on the surface of the cylinder 1 by exposure to the reflected light rays. The electrostatic latent image is then developed and made visible by a cascade developing device 50 in which a developing material consisting of a mixture of toner and carrier is received and supplied to the latent image by a rotating impeller 56 to develop the latent image with the toner in the developer, the toner adhering to the electrostatic latent image to render it visible. The visible toner image on the cylinder 1 is then transferred to a sheet 17 by the aid of a corona device 11. The sheet 17 bearing the toner image is fed toward a fixing device 21 in which the toner image is heat-fused and fixed thereon to form a permanent image. The sheet with the toner image fixed thereon is then discharged toward a delivery tray 23.

Residual toner remaining on the surface of the cylinder 1 is charged to the opposite polarity by a pre-cleaning conrona device 12 and then wiped or removed from the cylinder by a cleaning web 14 of a cleaning device 13. After passing the cleaning station, the photoconductive insulating layer 2 of the cylinder 1 remains in a charged state. Therefore, the photoconductive layer 2 is then subjected to discharging by a lamp 15 to render the layer electrically conductive thereby allowing all the remaining electrostatic charge to be grounded through the substrate of the cylinder. The above mentioned steps of uniformly charging, light ray exposing, developing, transferring, cleaning, and discharging complete one cycle of copying. Within the developingdevice 50 is an impeller 56 which rotates in the direction of arrow C at a speed of 350 to 500 rpm. The developer material blown up by the impeller 56 is deflected by a deflector 58 and directed toward the cylinder 1. A developing electrode 54 is provided in the vicinity of the cylinder 1 for producing the electrode effect between the electrostatic latent image on the surface of the cylinder 1 and the electrode 54 so as to obtain a high developing effect. After development, the developer is allowed to fall (guided by a guide plate 55), and is received in the bottom 53 of the housing 51 of the developing device 50, the toner to carrier ratio (toner concentration) being smaller than that of the original since the toner has been consumed in the developing station. As the toner is depleted, fresh toner is added from a toner reservoir 59 through a roller 60.

During the operation of the machine, charged particles of toner fly within the housing 51 of the developing device 50 and are attracted by metallic portions of the device. The toner tends to adhere, in particular, to the impeller 56, the deflector 58, the developing electrode 54, the guide plate 55, and the inside surface of the housing 51 which are in direct contact with the flying developer, and this results in the deterioration of the conductivity of these parts.

Figure 2:
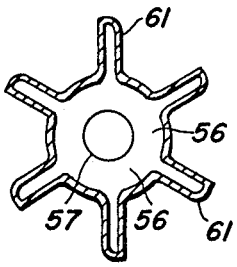
FIG. 2 is a sectional view of an impeller provided with a surface coating.

According to the present invention, the surfaces of these parts which is apt to allow deposition or adhesion of the toner are coated with a material having electrical conductivity, but presenting no affinity with the developer. The surfaces of the parts susceptible to contact with the developer are treated by sand-blasting to provide a rough surface, and then cleaned with an organic solvent and dried. This prepared surface is next uniformly coated with a conductive silicone of the type which sets at a room temperature, such as Silicone-X-31-076 commercially available from Shinetsu Chemicals, and is then left at an ambient termperature for about 24 hours. FIG. 2 shows an impeller 56, on the surface of which is a conductive layer 61 having no affinity with the toner formed by the above mentioned procedures. Silicone of the room temperature vulcanizing type, gives an excellent non-affinity with the toner and its electrostatic conductivity is good, lower than $10^8$ ohms per centimeter. Additionally, the above value of the electrostatic conductivity may be readily attained by adjusting the amount of carbon black to be added.

Figure 3:
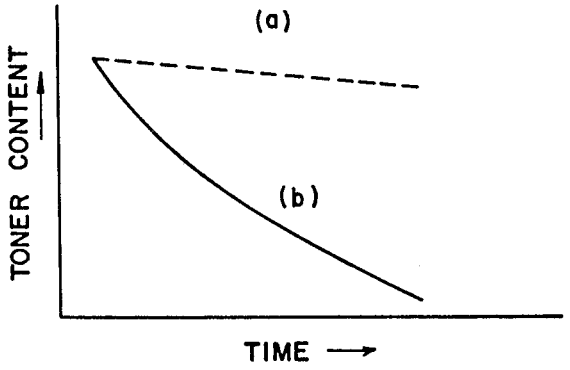
FIG. 3 is a graph showing the relation of the toner to carrier ratio with time.

FIG. 3 is a graph showing the results obtained by an impeller 56 divided into two halves by a plane perpendicular to the longitudinal axis of the impeller, one half being coated with a silicone of the room-temperature setting type, and the other half being left bare to expose its metallic surface. The measurement was made after rotating the prepared impeller in contact with a developer having a normal toner concentration. Dotted line *a* represents the results obtained with the coated layer 61 and a solid line *b* corresponds to the results obtained with the bare metallic surface. As is apparent from the graph, the toner in the developing material has adhered to the bare metallic surface causing a remarkable lowering of the toner concentration, while with the impeller provided with a coating layer 61 no appreciable lowering of the toner concentration has been observed.

Figure 4:
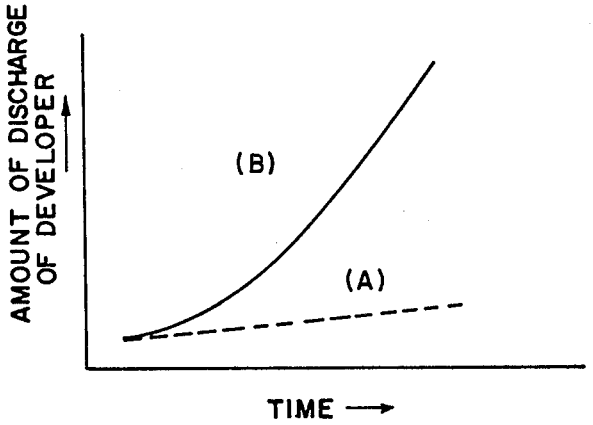
FIG. 4 is a graph illustrating the relationship of the amount of the charge on the developer with respect to time.

FIG. 4 is a graph illustrating the amounts of the charge of the developer measured by using the same impeller used in the experiments shown in FIG. 3. As shown by the solid line B (corresponding to the bare metallic half of the impeller), the amount of the electrostatic charge in this area increases due to the formation of an insulating layer of toner as time passes, while in the area coated with a coating layer 61, (shown by the dotted line A), there is only a slight increase or build-up of the charge, this clearly owing to the fact that the charge of the developer leaks through the layer 61 which is conductive and having no affinity with the toner.

Figure 5:
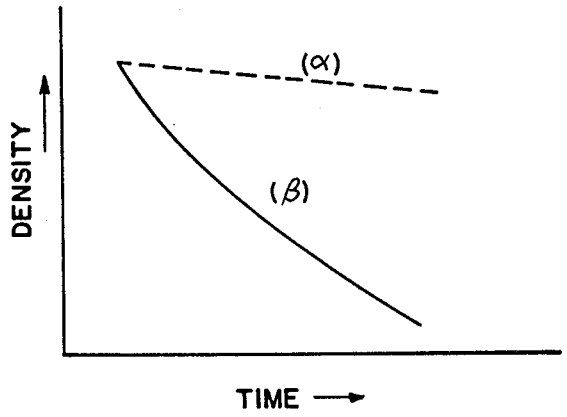
FIG. 5 is a graph showing the relationship between time and the image density.

In FIG. 5, solid line $\beta$ illustrates the decrease of the image density obtained by the bare metallic half of the impeller, and a dotted line $\alpha$ shows that degradation of the image density has hardly occurred with the coated half of the impeller, both experiments having been conducted without replenishing the toner. These results show that a stable image density can be maintained by the formation of the conductive layer 61.

While the present invention has been described in relation to an impeller 56, it will be apparent that the invention is also applicable to other parts such as the developing electrode 54, the deflector 58, the guide plate 55, the interior surface of the housing 51, or to any other part which is liable to be contacted by the developer.

According to the present invention, surfaces of parts located within the developing device susceptible to contact with the developer during operation are coated with a conductive material presenting no affinity with the developer, thereby avoiding the risk of toner particles adhering to or being deposited on surfaces of these parts which would otherwise cause the decay of the electrical conductivity thereof. This prevents the decrease of the reproductivity of the solid black areas due to the degradation of the developing electrode, and also prevents a decrease in the image density due to the build-up of charge on the developer. Moreover, since there is no risk that the toner is consumed by the adhesion to various parts during development, it is possible to more accurately control toner concentration thus, deposition of toner in background areas due to excess toner can be obviated, and the lowering of image density due to toner shortage is prevented.

While the invention has been described with reference to the structure disclosed, it is not confined to the details set forth, but is intended to cover such modifications or changes as may come within the scope of the following claims.

What is claimed is:

1. An improved developing device for developing an electrostatic latent image on a photoconductive surface of a copying machine, the device having means for holding a mixture of carrier particles and toner particles, and means for transporting at least a portion of the mixture onto the photoconductive surface, wherein the improvement comprises:

a coating on the surface of the transporting means, the coating having no affinity with the toner particles.

2. An improved developing device as set forth in claim 1, wherein the coating is conductive.

3. An improved developing device as set forth in claim 1, wherein the coating is a silicone which vulcanizes at room temperature.

* * * * *